US006244571B1

(12) United States Patent
Reid et al.

(10) Patent No.: US 6,244,571 B1
(45) Date of Patent: Jun. 12, 2001

(54) CONTROLLED BUCKLING BREAKAWAY CABLE TERMINAL

(75) Inventors: John D. Reid; John R. Rohde; Dean L. Sicking, all of Lincoln, NE (US)

(73) Assignee: Safety by Design, Inc., Lincoln, NE (US)

( * ) Notice: Subject to any disclaimer, the term of this patent is extended or adjusted under 35 U.S.C. 154(b) by 0 days.

(21) Appl. No.: 09/238,115

(22) Filed: Jan. 27, 1999

(51) Int. Cl.[7] ..... A01K 3/00; E01F 15/00

(52) U.S. Cl. ..... 256/13.1; 256/1; 404/6; 404/9; 404/10

(58) Field of Search ..... 256/13.1, 1; 404/6, 404/7

(56) References Cited

U.S. PATENT DOCUMENTS 4,678,166 * 7/1987 Bronstad et al. ..... 256/13.1
4,722,513 * 2/1988 Gaillard et al. ..... 256/13.1
5,547,309 * 8/1996 Mak et al. ..... 256/13.1 X
5,775,675 * 7/1998 Sicking et al. ..... 256/13.1
6,022,003 * 2/2000 Sicking et al. ..... 256/13.1
6,173,943 * 1/2001 Welch et al. ..... 256/13.1

FOREIGN PATENT DOCUMENTS

435441 A2 * 7/1991 (EP) ..... 256/13.1

* cited by examiner

*Primary Examiner*—Lynne H. Browne
*Assistant Examiner*—Ernesto Garcia
(74) *Attorney, Agent, or Firm*—Jackson Walker L.L.P.

(57) ABSTRACT

A crash attenuation apparatus for use with a guardrail system having rail posts and rail elements. An impact head has a buffer nose section and a rail post breaking beam system. The post breaking beam system has upper and lower breaking beams attached to the head. A guide tube is attached to the side of the head. A strut member extends from a first attachment point on the rail element to a second point downstream. Upon impact by a vehicle, the head breaks the first rail post, before impacting the strut and buckling the rail element downstream.

6 Claims, 7 Drawing Sheets

CONTROLLED BUCKLING BREAKAWAY CABLE TERMINAL

BACKGROUND OF THE INVENTION

The present invention relates to an impact attenuation device. Specifically, the invention relates to a controlled kinking breakaway cable terminal.

Prior art attenuation systems are disclosed in U.S. Pat. Nos. 4,655,434; 4,678,166; 4,928,928; 5,407,298; and 5,775,675.

A purpose of the controlled kinking breakaway cable terminal (CKBCT) is to provide a safe method for treating the ends of open-section guardrails, such as the W-beam guardrail. The new terminal uses a flared configuration to the travelway similar to the existing breakaway cable terminal (BCT) or the modified eccentric loader terminal (MELT). The terminal, when impacted in an end-on configuration, allows the impacting vehicle to penetrate the terminal in a controlled manner and to go behind the guardrail installation. For impacts with the side of the terminal, the terminal will contain and redirect the impacting vehicle.

SUMMARY OF THE INVENTION

The present invention provides a crash attenuation apparatus or controlled kinking terminal with an improved impact head which slides along the rail element breaking the first rail post prior to the initial buckling of the rail element. The head has a buffer nose portion supported by gusset plates. The head is further provided with two post breaking beams attached to the gusset plates. A guide tube is attached to the side of the head to guide a W-beam guardrail element. An improved strut may be connected to the rail element to control the downstream location of rail buckling upon impact to the terminal. Brackets attach a rigid, elongated strut to two spaced-apart locations along the rail element. The strut spans the curvature of the rail to ensure that the rail buckles downstream of the head after the first rail post is broken by the post breaking beam system.

BRIEF DESCRIPTION OF THE DRAWINGS

The invention will be better understood and objects other than those set forth above will become apparent when consideration is given to the following detailed description of the preferred embodiments. Such description makes reference to the annexed drawings wherein.

DETAILED DESCRIPTION OF THE PREFERRED EMBODIMENT

Figure 1:
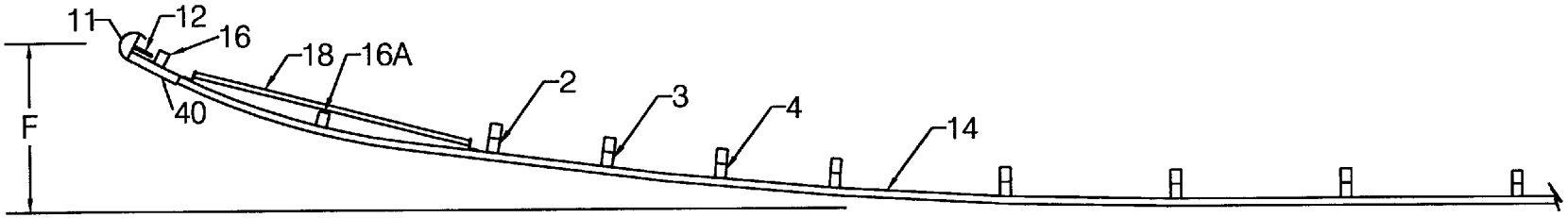
FIG. 1 illustrates a top plan view of the terminal of the present invention.
Figure 1A:
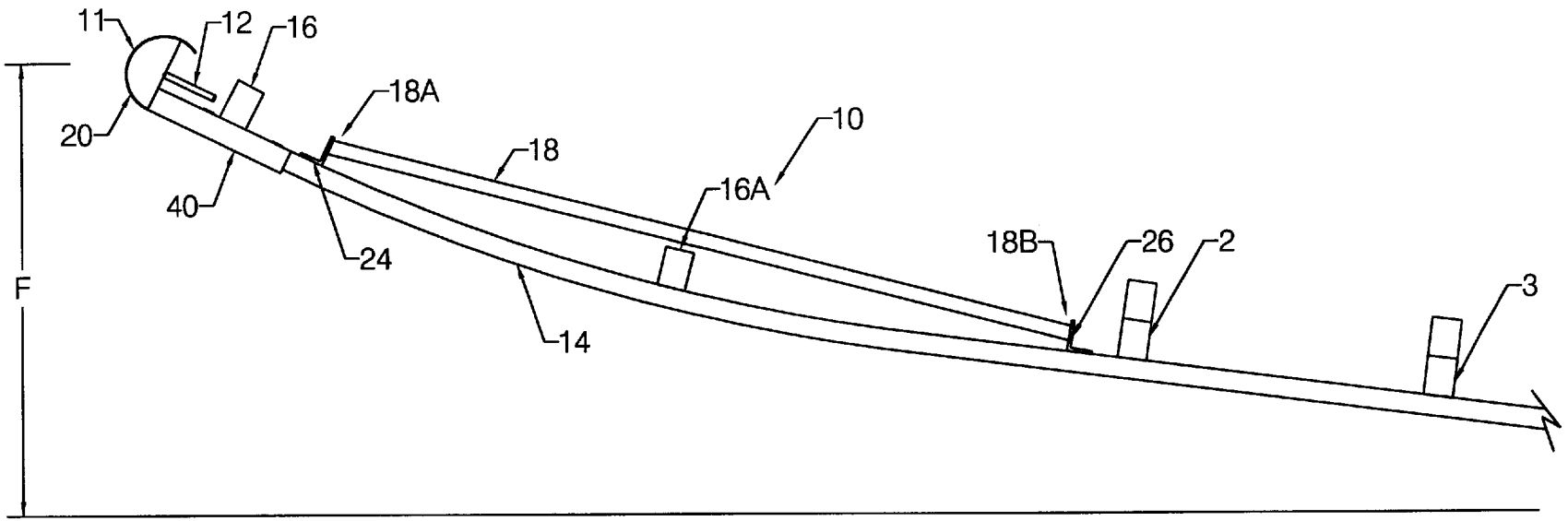
FIG. 1A illustrates a detailed top plan view of the front section of the present invention.

The controlled kinking concept of the present invention 10 entails two significant improvements over the existing BCT or MELT terminals. First, the impact head 11 is provided with a post breaker system 12. The head 11 slides along the rail element 14 which allows the end post 16 to be broken prior to buckling of the rail element 14. This arrangement separates the impulse imparted on the vehicle by the breaking the end post from the impulse imparted by buckling of the rail element.

Second, a strut 18 with one end 18A connected to near the end of the rail element and the other end 18B connected to the rail element just upstream of post 2, 3 or 4 controls where buckling of the rail element will occur to provide optimal impact performance for the terminal.

For end-on impacts, the vehicle will contact the front end 20 of the impact head 11 and push it backward along the rail element 14. The post breaker system 12 incorporated into the impact head 11 will break off the end post 16 prior to any forces acting on the rail element 14 to buckle the rail element. After the end post 16 is broken off and the cable anchor 22 is released, the vehicle will proceed forward in contact with the impact head 11. The impact head then contacts the upstream end of the strut 18, which is connected on one end 18A to a first end 24 of the rail element, transmitting the impact force downstream to the rail element 14 where the other end 18B of the strut 18 is connected to a second section 26 of the rail element, buckling the rail element at that point. Where the strut 18 is connected controls where buckling of the rail element 14 is to occur. After the rail element is buckled, the vehicle will then proceed and go behind the terminal and guardrail in a controlled manner similar to a BCT or MELT.

For impacts that are either end-on at a large angle or near the end of the terminal (e.g., between posts 16 and 16A), the impacting vehicle will break off the first couple of posts, bend the rail element, and gate behind the terminal and guardrail installation.

For impacts into the side of terminal downstream of the beginning of length-of-need which is selected to be a post 2 (or 12 feet 6 inches) downstream from the terminal end, the terminal will act like a standard guardrail section and will contain and redirect the impacting vehicle. The cable attachment 22 will provide the necessary anchorage to resist the tensile forces acting on the rail element to contain and redirect the vehicle during such side impacts.

Figure 2:
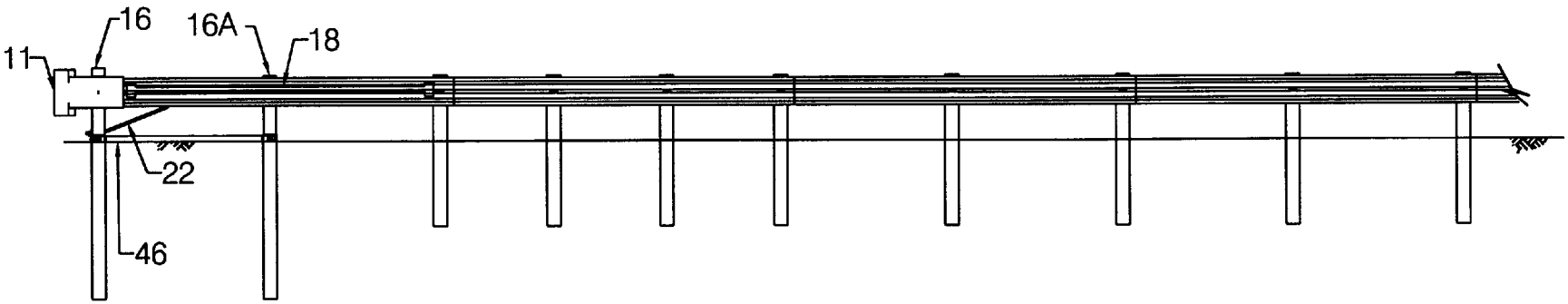
FIG. 2 shows a side elevation view of the terminal of the present invention.
Figure 2A:
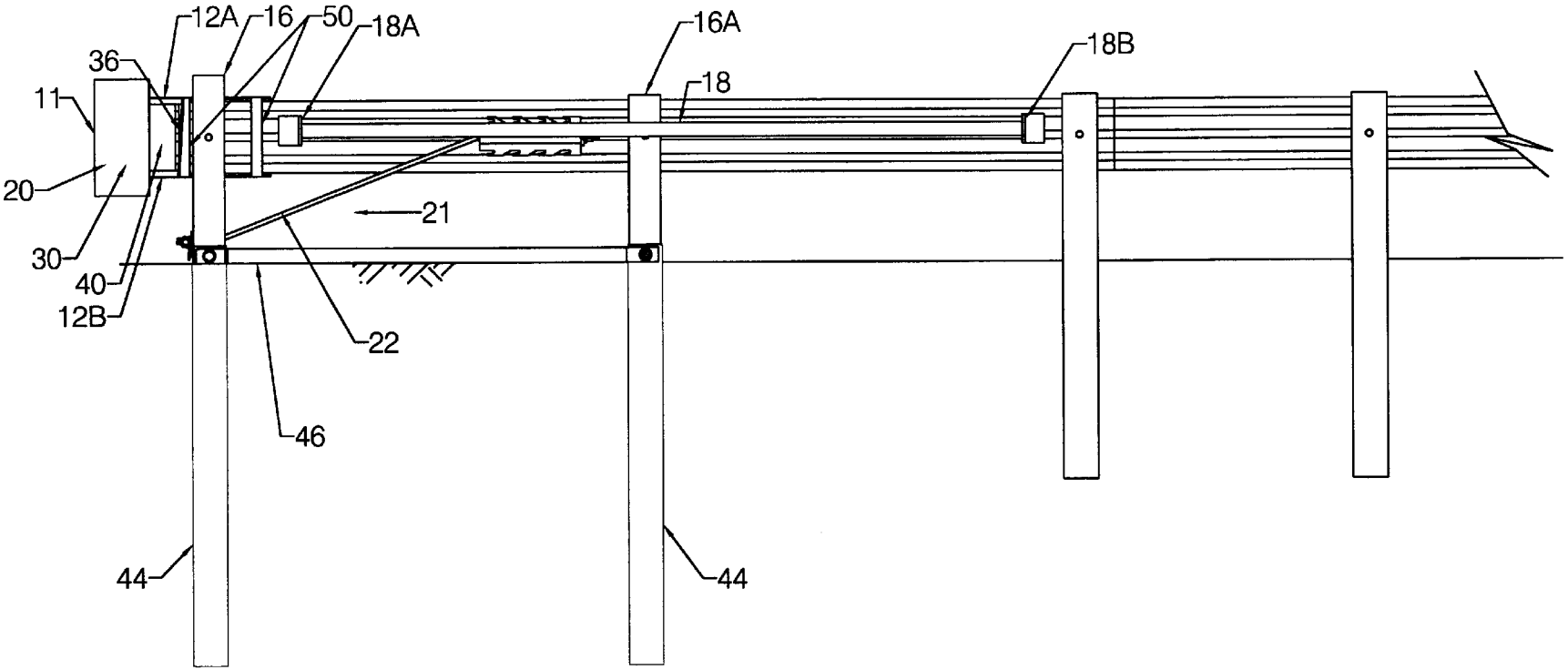
FIG. 2A shows a detailed side elevation view of a front section of the present invention.

FIG. 1 shows an overall layout of the terminal from a top view. FIG. 2 shows the terminal in side view. The controlled kinking breakaway cable terminal 10 is approximately 11.4 m (37 feet, 6 inches) in length and is installed in a flared configuration to the travelway with an offset F.

The terminal includes three 3.8 m or two 7.6 m rail sections with 3.8 m extending into the standard guardrail section. The rail element is flared in a parabolic curve similar to that of the BCT or the MELT.

Figure 3A:
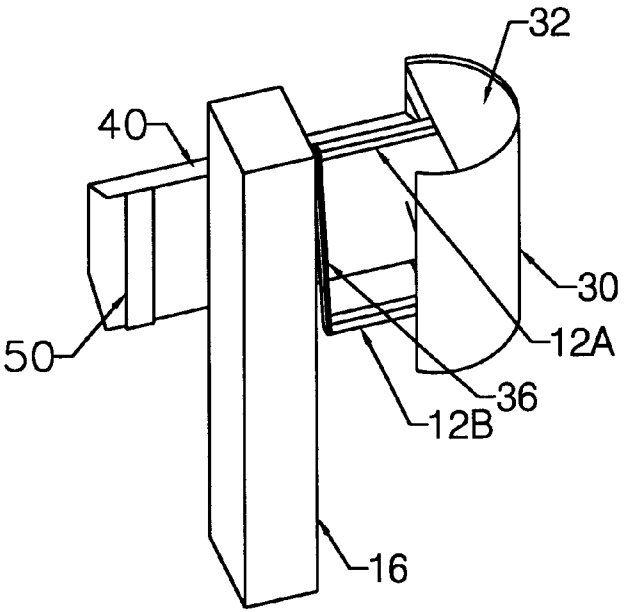
FIG. 3A shows a perspective view of the impact head of the present invention.
Figure 3:
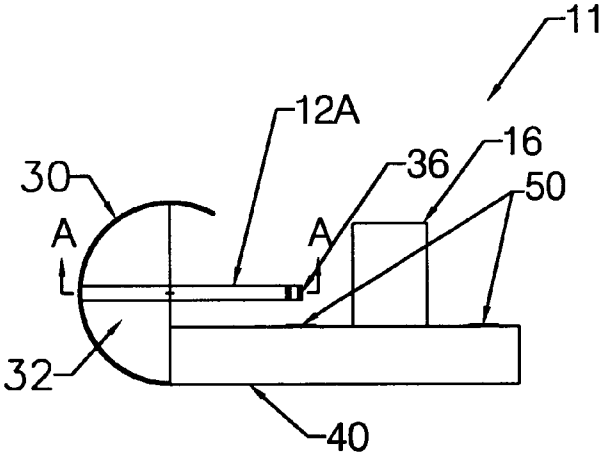
FIG. 3 shows a detailed top plan view of the impact head of the present invention.
Figure 4:
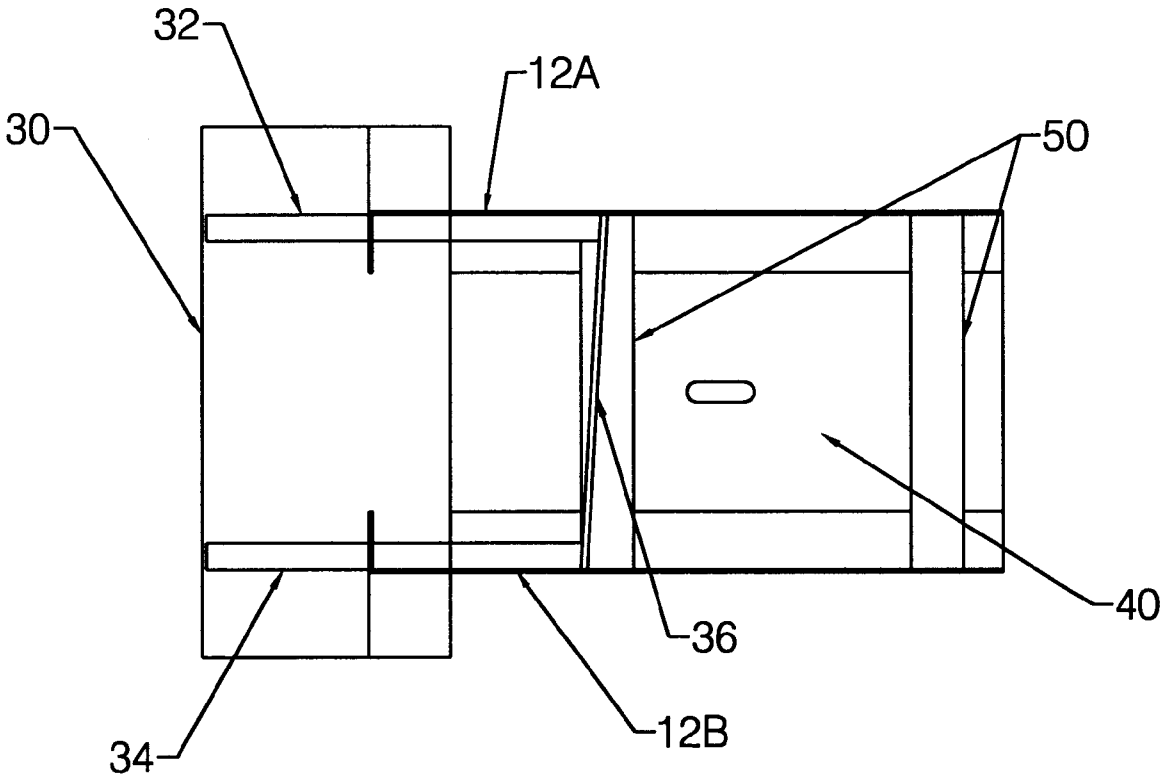
FIG. 4 illustrates a detailed, side elevation view of the impact head of the present invention.
Figure 6:
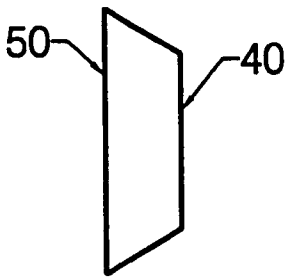
FIG. 6 illustrates an end elevational view of the guide tube of the present invention.
Figure 5:
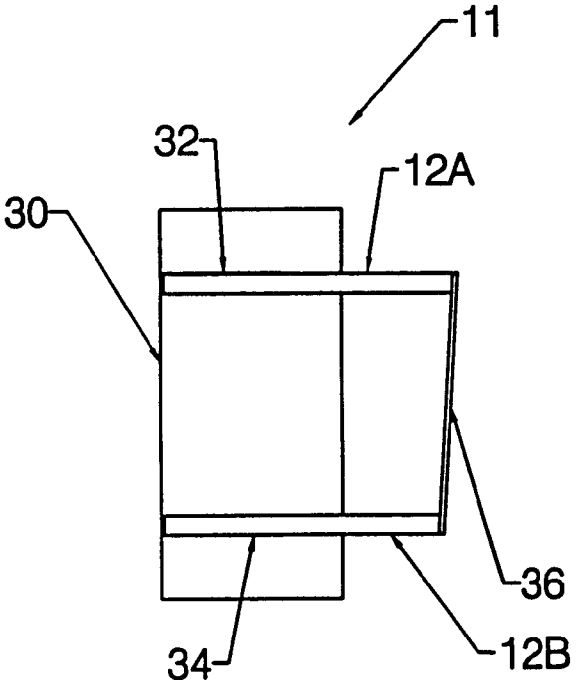
FIG. 5 shows a partial cross-sectional view taken along line A—A in FIG. 3.

The impact head 11 is shown in detail in FIGS. 3 and 3A. The impact head 11 includes:

A buffer nose 30 to distribute the impact load. Two gusset plates 32 and 34 reinforce the buffer nose and provide for attachment of the post breaker system 12. Two post breaker beams 12A and 12B are welded to the gusset plates 32 and 34 on one end and welded to a connecting strap 36 on the other end. The upper beam 12A is slightly longer than the lower beam 12B so as to initially impact the post 16 and create a rotational movement of the post 16. A guide tube 40 controls sliding of the impact head 11 along the rail element 14. Straps 50 are provided on tube 40 to maintain rigidity of the tube 40.

The first two posts are breakaway posts 16 and 16A, respectively made of wood or other suitable material and are placed in steel foundation sleeves 44 fitted in the ground. A ground strut 46 connects the two foundation sleeves for added capacity to the anchorage system. The remaining posts in the terminal are controlled release terminal (CRT) posts. The posts are spaced 1.9 m (6 feet, 3 inches), 1.27 m (4 feet, 2 inches), or 0.95 m (3 feet, 1½ inches) on center.

Anchorage to the terminal is provided by a cable release mechanism 21. The cable release mechanism 21 of a cable 22 attached on one end to the rail element and the other end to the end post and foundation sleeve.

Thus, the present invention 10 provides a buffered nose impact head 11 with post breaker system 12 to break off end post 16 prior to loading and buckling of the rail element 14 and a strut 18 connected by brackets on one end 18A to the end 24 of the rail element 14 and the other end 18B to the rail element just upstream of post 2, 3 or 4. After the impact head 11 breaks off the post 16, it impacts the strut 18, causing the rail element 14 to buckle.

Although the invention has been described with reference to a specific embodiment, this description is not meant to be construed in a limiting sense. On the contrary, various modifications of the disclosed embodiments will become apparent to those skilled in the art upon reference to the description of the invention. It is therefore contemplated that the appended claims will cover such modifications, alternatives, and equivalents that fall within the true spirit and scope of the invention.

What is claimed is:

1. A crash attenuation apparatus in combination with a guardrail system having rail posts and rail elements comprising:

an impact head having a nose portion and attached to the frontmost rail element of said rail elements, said head spaced apart from the frontmost post of said rail posts;

an upper rail post breaking beam and a lower rail post breaking beam attached to said impact head and extending downstream toward said frontmost post, the length of said upper post breaking beam being greater than the length of said lower post breaking beam, said breaking beams spaced apart from said frontmost post, said beams impact said frontmost post after said head is impacted;

a guide tube attached to said impact head; and a strut member having a first end and a second end, said strut member induces rail element buckling at a predetermined location along said frontmost rail element of said guardrail system, said strut member extends from a first attachment point on said frontmost rail element, said second end attached to a second attachment point on said frontmost rail element downstream of said first attachment point.

2. The apparatus of claim 1 further comprising an upper gusset plate and a lower gusset plate attached to said nose portion of said head, said upper post breaking beam attached to said upper gusset plate and said lower post breaking beam attached to said lower gusset plate.

3. The apparatus of claim 1 further comprising a stabilizing strap extending from said upper post breaking beam to and connecting with said lower post breaking beam.

4. A crash attenuation apparatus in combination with a guardrail system having rail posts and rail elements comprising:

an impact head having a nose portion;

an upper post breaking beam and a lower post breaking beam attached to said impact head, said upper post breaking beam having a greater length than said lower post breaking beam;

a guide tube attached to said impact head; and an upper gusset plate and a lower gusset plate attached to said nose portion of said head, said upper post breaking beam attached to said upper gusset plate and said lower post breaking beam attached to said lower gusset plate.

5. A crash attenuation apparatus in combination with a guardrail system having rail posts and rail elements comprising:

an impact head having a nose portion;

an upper post breaking beam and a lower post breaking beam attached to said impact head, said upper post breaking beam having a greater length than said lower post breaking beam;

a guide tube attached to said impact head; and a stabilizing strap extending from said upper post breaking beam to and connecting with said lower post breaking beam.

6. A crash attenuation apparatus in combination with a guardrail system having rail posts and rail elements comprising:

an impact head having a nose portion;

an upper post breaking beam and a lower post breaking beam attached to said impact head, said upper post breaking beam having a greater length than said lower post breaking beam;

a guide tube attached to said impact head; and a strut member having a first end and a second end, said strut member induces rail element buckling at a predetermined location along a first rail element of said guardrail system, said first end of said strut member attached to a first attachment point on said frontmost rail element and said second end of said strut attached to a second attachment point on said frontmost rail element downstream of said first attachment point.

* * * * *